US011543129B2

(12) United States Patent
Jones et al.

(10) Patent No.: US 11,543,129 B2
(45) Date of Patent: Jan. 3, 2023

(54) COMBUSTION CHAMBER AND HEAT EXCHANGER

(71) Applicant: HIETA TECHNOLOGIES LIMITED, Bristol (GB)

(72) Inventors: Simon Lloyd Jones, Bristol (GB); Calum Smith, Bristol (GB)

(73) Assignee: HIETA TECHNOLOGIES LIMITED, Bristol (GB)

( * ) Notice: Subject to any disclaimer, the term of this patent is extended or adjusted under 35 U.S.C. 154(b) by 618 days.

(21) Appl. No.: 16/321,603

(22) PCT Filed: Aug. 14, 2017

(86) PCT No.: PCT/GB2017/052385
§ 371 (c)(1),
(2) Date: Jan. 29, 2019

(87) PCT Pub. No.: WO2018/055325
PCT Pub. Date: Mar. 29, 2018

(65) Prior Publication Data

US 2020/0025379 A1 Jan. 23, 2020

(30) Foreign Application Priority Data

Sep. 23, 2016 (GB) ..... 1616210

(51) Int. Cl.
*F23R 3/00* (2006.01)
*F23R 3/06* (2006.01)
(Continued)

(52) U.S. Cl.
CPC ..... *F23R 3/005* (2013.01); *F23R 3/06* (2013.01); *F28D 1/06* (2013.01); *F23R 2900/03043* (2013.01); *F28D 2021/0024* (2013.01)

(58) Field of Classification Search
CPC .. F23R 3/002; F23R 3/005; F23R 3/06; F23R 2900/03043; F23R 2900/03044;
(Continued)

(56) References Cited

U.S. PATENT DOCUMENTS 3,736,747 A 6/1973 Warren
4,819,438 A 4/1989 Schultz
(Continued)

FOREIGN PATENT DOCUMENTS

EP 1 398 462 3/2004
EP 3 002 415 4/2016
(Continued)

OTHER PUBLICATIONS

International Search Report and Written Opinion of the ISA for PCT/GB2017/052385, dated Oct. 18, 2017, 15 pages.
(Continued)

*Primary Examiner* — Alain Chau
*Assistant Examiner* — Sean V Meiller
(74) *Attorney, Agent, or Firm* — Nixon & Vanderhye P.C.

(57) ABSTRACT

A combined combustor and recuperator is formed with the recuperator surrounding the combustor. Cold gas conduits (14, 16, 20) through the recuperator follow along involute paths toward the combustor. Hot has conduits (26) through the recuperator follow counterflow paths along corresponding involute curves outward from the combustor. The openings (18) in the combustion chamber wall through which cold gas enters the combustion chamber may be directed to impart flow direct to the cold gas to support particular desired behaviour of the cold gas in the portions of the combustion chamber concerned, e.g. supporting a stable vortex flame, enhancing mixing, providing a protective barrier layer.

21 Claims, 5 Drawing Sheets

Figure 1:
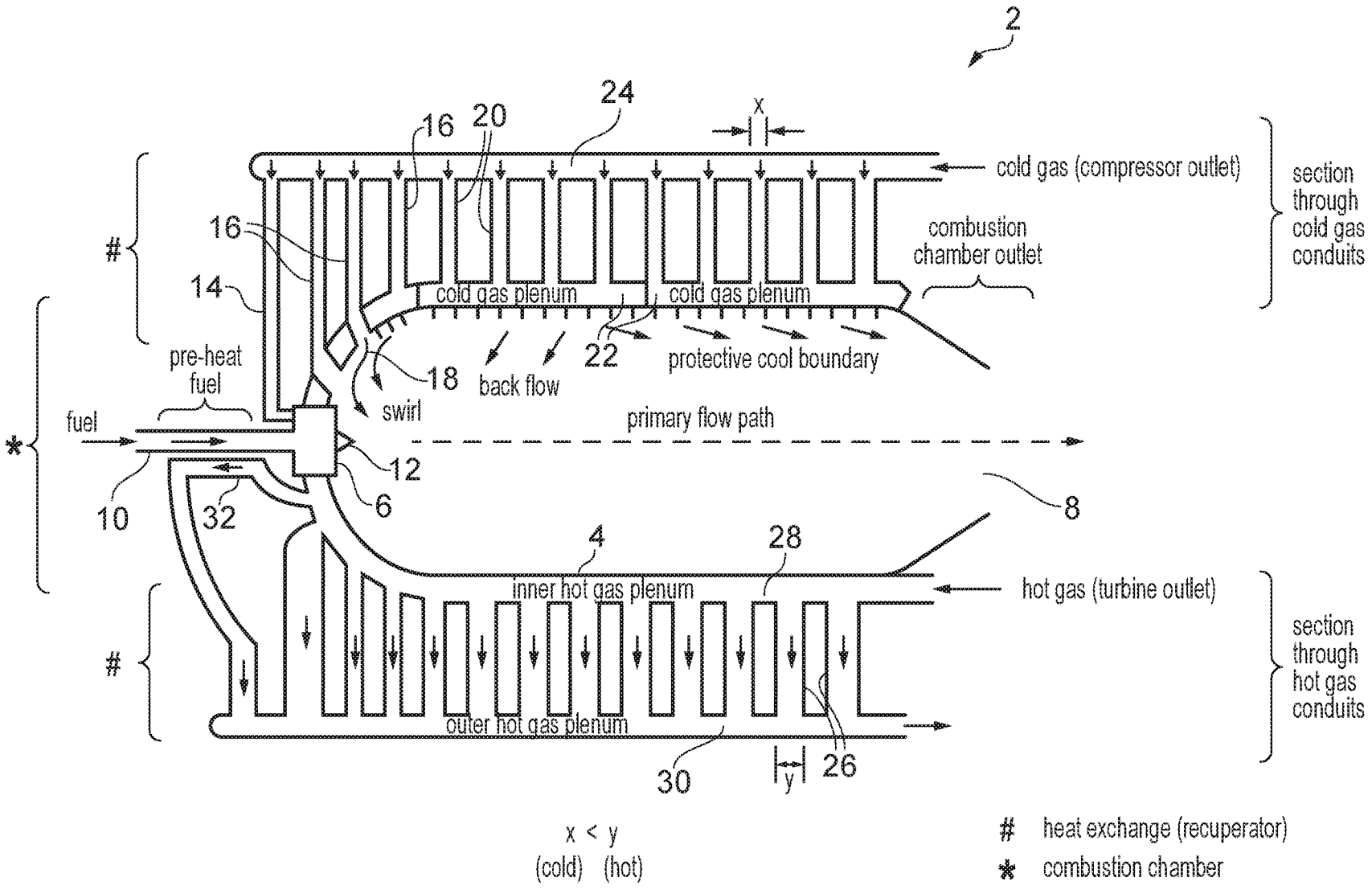

(51) Int. Cl.
*F28D 1/06* (2006.01)
*F28D 21/00* (2006.01)

(58) Field of Classification Search
CPC ..... F28D 1/06; F28D 2021/0024; F28D 2021/0026; F28F 7/02; F02C 7/10; F02C 7/224
See application file for complete search history.

(56) References Cited

U.S. PATENT DOCUMENTS

| | | | | |
|---|---|---|---|---|
| 4,877,396 | A | 10/1989 | Wunning | |
| 5,845,481 | A * | 12/1998 | Briesch | F02C 7/224 60/776 |
| 5,855,112 | A * | 1/1999 | Bannai | F23R 3/44 60/39.511 |
| 6,282,905 | B1 | 9/2001 | Sato et al. | |
| 6,711,889 | B2 * | 3/2004 | Kuo | F02C 3/14 165/164 |
| 8,573,291 | B2 * | 11/2013 | Vick | F23D 14/66 165/166 |
| 9,200,855 | B2 * | 12/2015 | Kington | F28F 9/0282 |
| 9,395,122 | B2 * | 7/2016 | Eleftheriou | F28D 21/0003 |
| 2004/0000148 | A1 | 1/2004 | Kuo et al. | |
| 2013/0098063 | A1 | 4/2013 | Mizukami et al. | |
| 2016/0195017 | A1 * | 7/2016 | Vick | F02C 7/22 60/39.511 |
| 2016/0265772 | A1 * | 9/2016 | Eastwood | F23R 3/04 |
| 2017/0133244 | A1 * | 5/2017 | Knyazik | F28F 3/12 |
| 2019/0040765 | A1 * | 2/2019 | Elsaket | F01K 23/10 |
| 2019/0145319 | A1 * | 5/2019 | Iwai | F23R 3/045 60/39.821 |

FOREIGN PATENT DOCUMENTS

| | | |
|---|---|---|
| FR | 669625 | 11/1929 |
| FR | 2 694 799 | 2/1994 |
| JP | H01-225810 | 9/1989 |
| JP | 2002-371864 | 12/2002 |
| JP | 2008-274774 | 11/2008 |
| JP | 2015-152190 | 8/2015 |
| WO | 2012/043073 | 4/2012 |
| WO | 2012/066311 | 5/2012 |

OTHER PUBLICATIONS

Search Report for GB1616210.9, dated Mar. 21, 2017, 6 pages.
Office Action for JP Application No. 2019-514302 dated May 10, 2021 and English translation, 14 pages.

* cited by examiner

COMBUSTION CHAMBER AND HEAT EXCHANGER

This application is the U.S. national phase of International Application No. PCT/GB2017/052385 filed 14 Aug. 2017, which designated the U.S. and claims priority to GB Patent Application No. 1616210.9 filed 23 Sep. 2016, the entire contents of each of which are hereby incorporated by reference.

This disclosure relates to the field of heat exchangers. More particularly, this disclosure relates to systems which incorporate a combustion chamber and a heat exchanger.

It is known to provide systems, such as heat engines (e.g. gas turbines), which include a combustion chamber in which fuel is burnt to generate hot gas and a heat exchanger, such as a recuperator used to recover energy from exhaust gas and thereby increase the efficiency of the heat engine. Measures which can increase the efficiency of a heat engine and/or reduce the size and/or weight of a heat engine are advantageous.

At least some embodiments of the present disclosure provide apparatus comprising:

a combustion chamber wall enclosing a combustion chamber; and a heat exchanger integral with at least a portion of said combustion chamber wall;

wherein the heat exchanger and the combustion chamber wall are formed together as one entity from a single body of material; and wherein said heat exchanger transfers heat from a hot gas to a cold gas and comprises a plurality of hot gas conduits to direct hot gas along respective hot gas paths, and a plurality of cold gas conduits to direct cold gas along respective cold gas paths;

wherein one or more of:

(i) at least some of said cold gas conduits directly connect to respective inlet openings in said combustion chamber wall;

(ii) at least some of said cold gas conduits directly connect to one or more cold gas plenums abutting said combustion chamber wall and plenum-inlet openings provide flow paths for said cold gas between respective ones of said one or more cold gas plenums and said combustion chamber; and (iii) said combustion chamber wall is porous and said cold gas passes from at least some of said cold gas conduits into said combustion chamber through porous openings in said combustion chamber wall.

The present disclosure recognizes that increases in thermal efficiency and reductions in the size and mass of a system may be achieved, at least in some embodiments, when a heat exchanger is integrally formed with at least a portion of a combustion chamber wall. The heat exchanger and the combustion chamber wall are formed together as one entity, such as being formed together with the same material in an additive manufacturing process whereby the combustion chamber wall and the heat exchanger comprise a single body of material. Such an arrangement permits a more compact design and allows better heat transfer between the heat exchanger and the combustion chamber, as may be desired.

Whilst the combustion chamber can have a wide variety of different forms, in at least some embodiments of the disclosure the combustion chamber has a primary combustion chamber inlet and an combustion chamber outlet with a primary fluid flow path extending between the primary combustion chamber inlet and the combustion chamber outlet. A fuel and air mixture to be combusted may flow along this primary fluid flow path.

The heat transfer between the heat exchanger and the combustion chamber may be improved, and the combined apparatus made more compact, when the heat exchanger at least partially surrounds the combustion chamber in planes normal to at least a portion of the primary fluid flow path. Thus, the heat exchanger will at least partially wrap around the combustion chamber.

In some embodiments of the disclosure, the heat exchanger may fully surround the combustion chamber in planes normal to at least a portion of the primary fluid flow path. For example, if the combustion chamber has the form of an approximate cylinder with the fluid flow path extending along the axis of the cylinder, then the heat exchanger may have an annular cross section surrounding the combustion chamber. The portion of the primary fluid flow path for which the heat exchanger partially or fully surrounds the combustion chamber may in some embodiments extend along the entirety of the primary fluid flow path thereby increasing the amount of heat transfer possible between the heat exchanger and the combustion chamber wall, and accordingly the combustion gases within the combustion chamber.

The heat exchanger may serve to transfer heat from a hot gas to a cold gas and accordingly include a plurality of hot gas conduits to direct hot gas along respective hot gas paths and a plurality of cold gas conduits to direct cold gas along respective cold gas paths. Heat exchange between a hot gas and a cold gas flowing along respective conduits can provide efficient heat transfer.

In some embodiments the hot gas paths may flow away from the combustion chamber and the cold gas paths flow toward the combustion chamber and substantially parallel with the hot gas paths. Such an arrangement tends to locate the hottest of the hot gas close to the combustion chamber and the hottest of the cold gas closest to the combustion chamber in a manner which increases the efficiency with which heat may be transferred. Such an arrangement provides counterflow heat exchange between the hot gas and the cold gas.

In other possible example embodiments, the hot gas paths may cross to the cold gas paths as they pass through the heat exchanger in a way which provides a cross-flow type of heat exchanger. Such an arrangement may be preferred in embodiments in which simplicity of manifolding to route the hot gas and the cold gas are priorities.

Heat transfer between the hot gas and the cold gas may be improved in efficiency and the material requirements of the heat exchanger reduced when the hot gas conduits and the cold gas conduits share at least some conduit boundary walls.

In some example embodiments the cold gas from the cold gas conduits may be introduced into the combustion chamber through the combustion chamber wall. For example, the cold gas may be air which is pre-heated within the heat exchanger before it is introduced and forms part of the combustion process taking place within the combustion chamber. In this context, the cold gas conduits may connect/communicate with the combustion chamber in a variety of different ways. These different ways of connecting the cold gas conduits to the combustion chamber may be used separately or in combination with a given embodiment.

Some of the cold gas conduits may directly connect to respective inlet openings within the combustion chamber wall. Other of the cold gas conduits may directly connect to one or more cold gas plenums which adjoin the combustion chamber wall and themselves have plenum-inlet openings which provide flow paths for the cold gas between the cold gas plenums and the combustion chamber.

It is also possible that the combustion chamber wall may be formed so as to be porous rather than having particular and specific openings therein such that cold gas from the cold gas conduits may pass into the combustion chamber through porous openings in the combustion chamber wall. Such a porous combustion chamber wall may form one wall of, for example, a plenum holding cold gas and connected to one or more cold gas conduits within the heat exchanger.

In addition to providing cold gas through the combustion chamber wall, at least some of the cold gas conduits may serve to provide a portion of the cold gas to the primary combustion chamber inlet. By directing different portions of the cold gas through respective cold gas conduits a predictable and accurate division of the flow of cold gas may be achieved with a particular desired proportion of that cold gas being fed in by the primary combustion chamber inlet and another specific portion or portions being fed into the combustion chamber through the combustion chamber wall in a controlled manner through other of the cold gas conduits.

The ability to evenly direct the hot gas through the hot gas conduits may be improved by the use of one or more inner hot gas plenums proximal to the combustion chamber to supply hot gas to the hot gas conduits and one or more outer hot gas plenums distal from the combustion chamber for collecting the hot gas from the hot gas conduits. Such an arrangement enhances the evenness with which the hot gas is flowed through the hot gas conduits and ensures that the hottest of the hot gas is close to the combustion chamber wall in a manner which increases heat transfer.

The combustion chamber may also be supplied with fuel through one or more fuel conduits. The fuel within the fuel conduits may be pre-heated using the heat exchanger integrally formed with the combustion chamber wall such as by one or more of: using hot gas conduits proximal to the fluid conduits; using cold gas conduits (still containing gas which will typically be hotter than the fuel) close to the fuel conduits; and by directly absorbing heat from the body of the heat exchanger itself. The fuel conduits may supply fuel directly to the primary combustion chamber inlet.

The shapes of the paths followed by the hot gas conduits and the cold gas conduits can vary. In some embodiments, respective ones of the hot gas conduits and the cold gas conduits follow involute paths that are an involute of an outer cross sectional boundary of the combustion chamber wall in a cross sectional plane containing the corresponding involute path. Such an arrangement allows the hot gas conduits and the cold gas conduits to be packed closely together and to have a constant, or substantially constant, cross sectional area along their length in a manner suited to efficient operation.

While the cross sectional boundary from which the involute paths are drawn, and in which plane they lie could take a variety of different forms. This outer cross sectional boundary may conveniently be circular and perpendicular to the primary flow path in the case of a combustion chamber in the form of a cylinder.

Whilst a wide variety of different relationships are possible in the disposition of the hot gas conduits and the cold gas conduits, in at least some embodiments efficient heat transfer may be promoted when these are interleaved around the combustion chamber.

In some embodiments, the hot gas conduits have cross sectional areas normal to the hot gas paths that are greater than the cross sectional areas of the cold gas conduits normal to the cold gas paths. Providing larger cross sectional areas for the hot gas paths relative to the cold gas paths increases the efficiency with which the heat transfer may be achieved as the hot gas is typically less dense than the cold gas and accordingly requires larger conduits for the same mass flow.

The inlets through which the cold gas may be supplied into the combustion chamber may be formed so as to direct the cold gas to flow with a mean direction that is non-normal to the combustion chamber wall in a manner which tailors the introduction of the cold gas into the combustion chamber at specific points to the requirements of those specific points. For example, the combustion chamber inlet openings proximal to the primary combustion chamber may direct the cold gas to enter the combustion chamber with a mean flow direction rotating around the primary flow path in a manner which supports and enhances the generation of a stable vortex airflow within the combustion gas helping to provide consistent and thorough combustion. Other combustion chamber inlet openings proximal to the combustion chamber outlet may serve to direct the cold gas to enter the combustion chamber with a mean flow direction having a component parallel with and in the same direction as the primary flow path which may assist in helping to provide a layer of relatively cool gas close to the combustion chamber wall thereby separating the combustion chamber wall from the hottest of the combustion gasses in a manner which reduces the erosion of the combustion chamber wall. Other of the combustion chamber inlets at an intermediate position along the primary flow path direct the cold gas to enter the combustion chamber with a mean flow direction having a component parallel with and opposite from the primary flow path in a manner which enhances the mixing of such cold gas with the combustion gasses from the primary inlet.

Whilst the combustion chamber wall and the heat exchanger may be formed in a variety of different ways, such as casting, in at least some embodiments the apparatus is formed of consolidated powder material, such as may be used in additive manufacturing processes, e.g. energy beam melted metal powder consolidated to form the combined combustion chamber wall and heat exchanger.

While the heat exchanger may serve a variety of different thermodynamic roles within the system, in at least some embodiments the heat exchanger may be a recuperator serving to transfer heat from waste exhaust gases into cold gas which is to be combusted within the system.

Such a recuperator may be advantageously used within the context of a turbine driven by the combustion gas from the combustion chamber to produce exhaust gas which is the hot gas of a recuperator serving to receive cold gas from a compressor driven by the turbine and to transfer heat from the hot gas in to the cold gas which is to be supplied to the combustion chamber.

The apparatus can be formed by additive manufacture. In additive manufacture, an article may be manufactured by successively building up layer after layer of material in order to produce an entire article. For example the additive manufacture could be by selective laser melting, selective laser centring, electron beam melting, etc. The material used for the heat exchanger and combustion chamber wall can vary, but in some examples may be a metal, for example aluminium, titanium or steel or could be an alloy. The additive manufacture process may be controlled by supplying an electronic design file which represents characteristics of the design to be manufactured, and inputting the design file to a computer which translates the design file into instructions supplied to the manufacturing device. For example, the computer may slice a three-dimensional design into successive two-dimensional layers, and instructions representing each layer may be supplied to the additive manufacture machine, e.g. to control scanning of a laser across a powder bed to form the corresponding layer. Hence, in some embodiments rather than providing a physical apparatus, the technique could also be implemented in a computer-readable data structure (e.g. a computer automated design (CAD) file) which represents the design of an apparatus as discussed above. Thus, rather than selling the apparatus in its physical form, it may also be sold in the form of data controlling an additive manufacturing machine to form such an apparatus. A storage medium may be provided storing the data structure. The storage medium may be a non-transitory storage medium.

Figure 2:
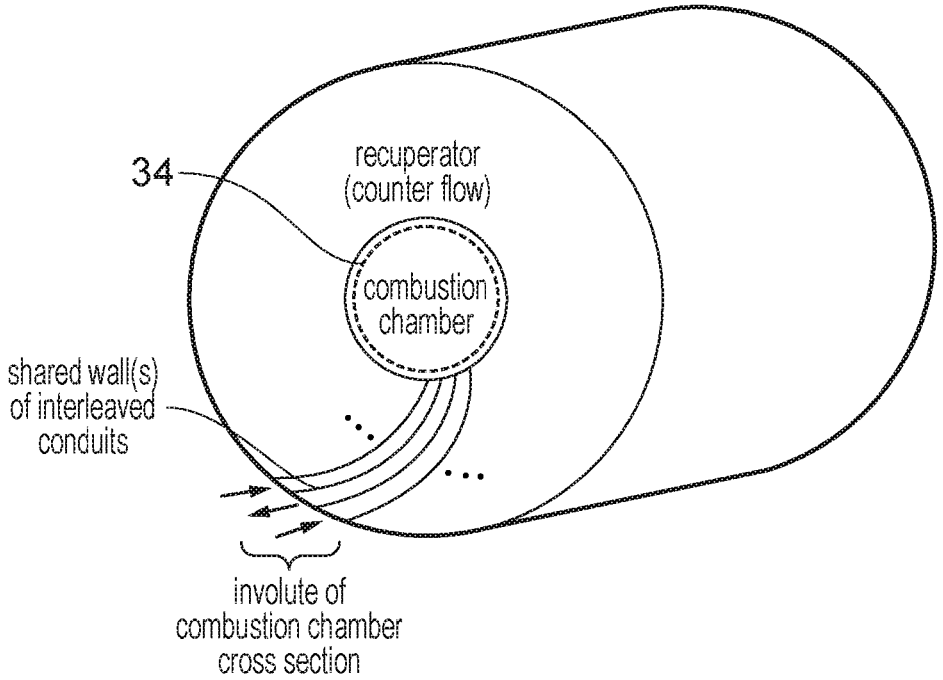
Figure 3:
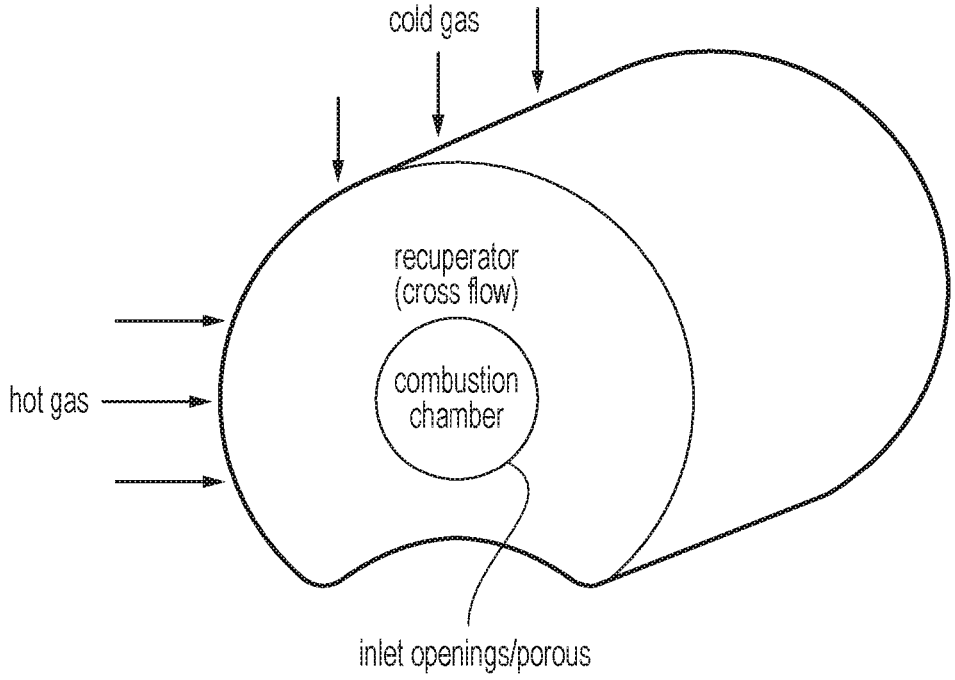
Figure 4:
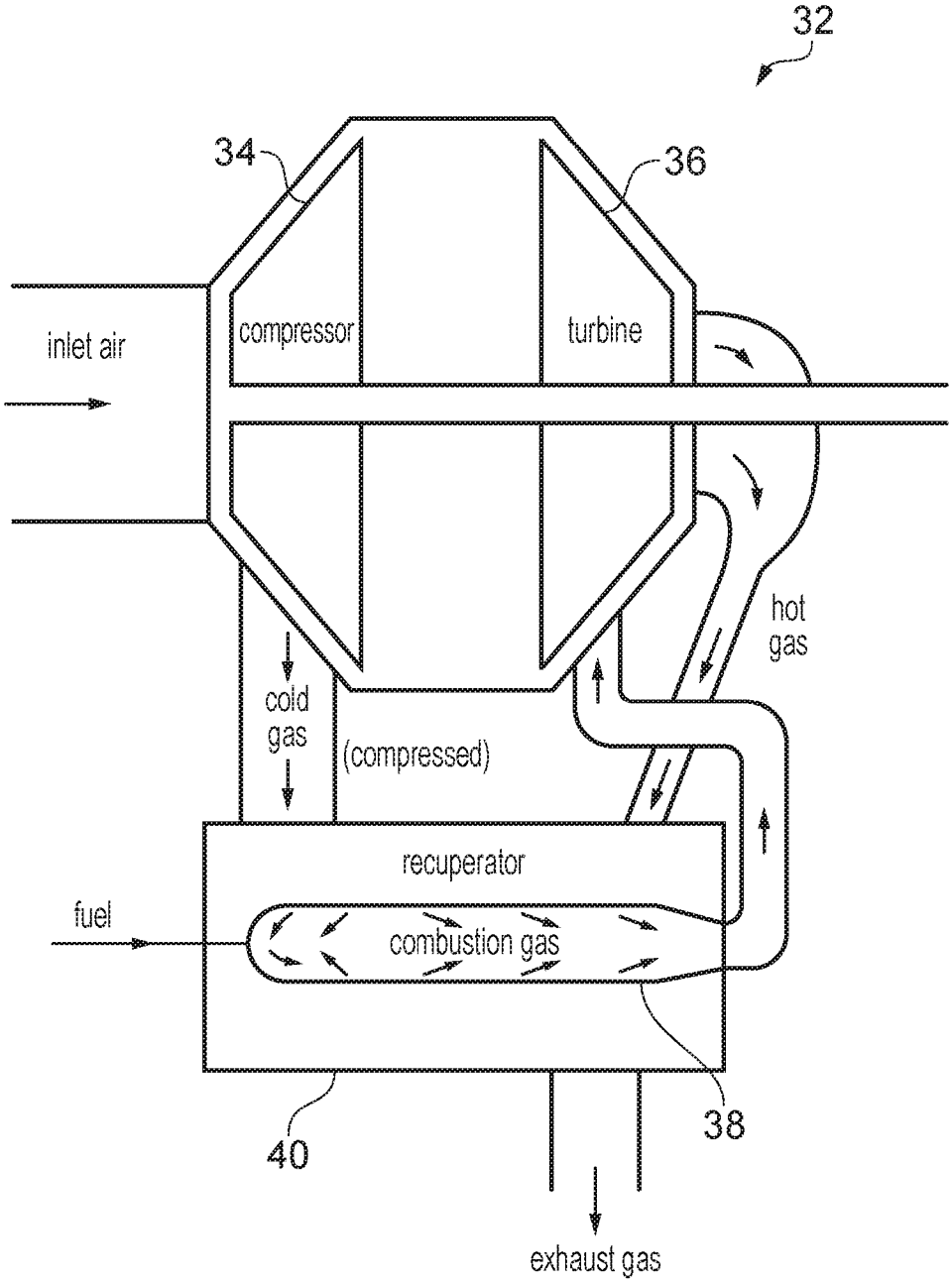
Figure 5:
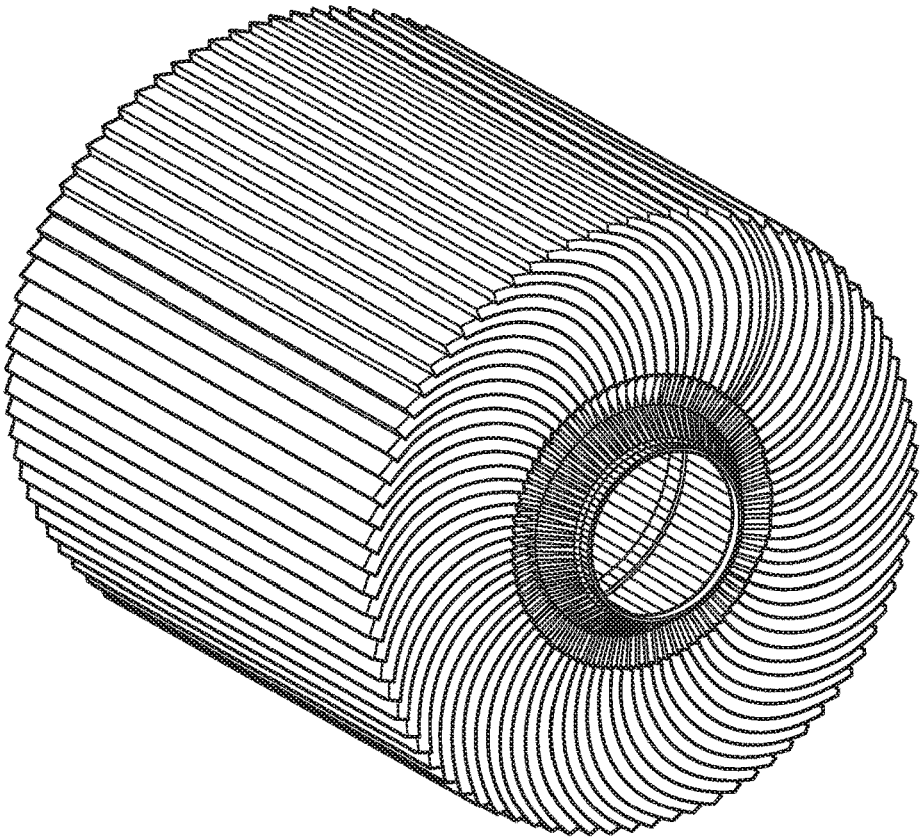
Figure 6:
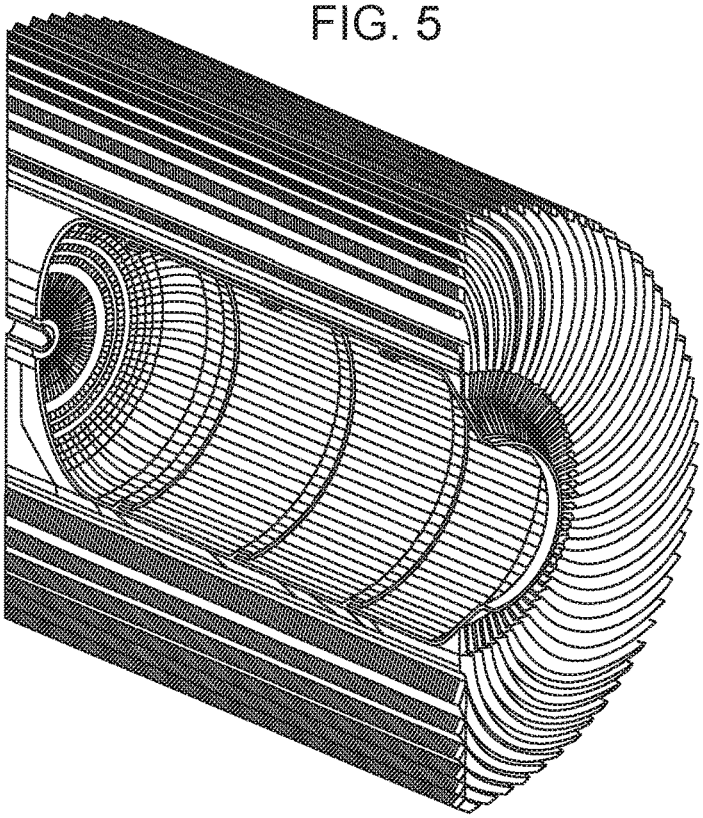
Figure 7:
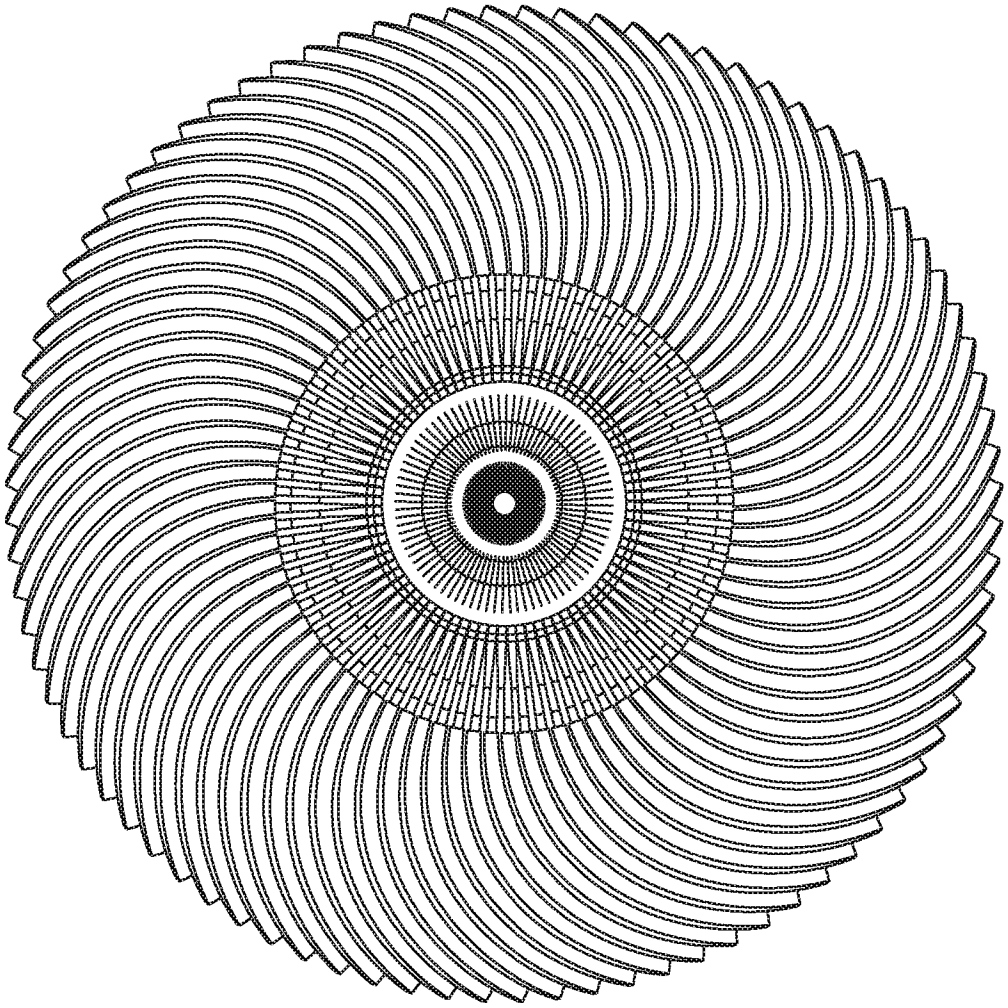

Example embodiments will now be described, by way of example only, with reference to the accompanying drawings in which:

FIG. 1 schematically illustrates a cross section through a first example combined combustor and recuperator;

FIG. 2 schematically illustrates a second example combined combustor and recuperator;

FIG. 3 schematically illustrate a third example combined combustor and recuperator;

FIG. 4 schematically illustrates a heat engine including a combined combustor and recuperator;

FIG. 5 schematically illustrate a fourth example combined combustor and recuperator;

FIG. 6 schematically illustrates a cross section through the combined combustor and recuperator of FIG. 5; and FIG. 7 schematically illustrates and end view (combustion chamber outlet end) of the combined combustor and recuperator of FIG. 5.

FIG. 1 schematically illustrates a combined combustor and heat exchanger 2. In this example the heat exchanger is in the form of a recuperator. The combustion chamber is bounded by a combustion chamber wall 4. The combustion chamber within the combustion chamber wall 4 includes a primary flow path for the combustion gasses extending between a primary combustion chamber inlet 6 and a combustion chamber outlet 8. The combustion chamber has a substantially cylindrical form in this example embodiment, although other shapes are also possible.

Fuel is passed through a fuel conduit 10 to the primary combustion chamber inlet 6. The fuel is expelled through a nozzle 12 into the combustion chamber where it is mixed with cold gas (air) which has passed through the recuperator and been heated by hot gas, which is also passed through the recuperator. Some of the cold gas is introduced through a cold gas conduit 14 directly into the primary combustion chamber inlet 6. This cold gas may pass through vanes which impart a rotating motion about the primary flow path. The fuel from the nozzle 12 mixed with this cold gas and burned (combusted). The combustion gas follows a vortex (swirling) path within a central portion of the combustion chamber toward to the combustion chamber outlet 8.

Further cold gas conduits 16 within the recuperator pass cold gas directly into the combustion chamber through inlets 18 within the combustion chamber wall 4. These inlets may be directed such that they impart a mean flow direction to the cold gas entering the combustion chamber with a component of motion which rotates around the primary flow path. This rotational motion of the cold gas introduced through the conduits 18 is used to support the swirling motion imparted to the cold gas introduced through the primary combustion chamber inlet 6 and help to maintain a stable vortex within which the fuel is combusted.

There are further cold gas conduits 20 within the recuperator which pass cold gas into cold gas plenums 22 which border (adjoin/abut) the combustion chamber wall 4. Openings within the combustion chamber wall 4 which connect to the cold gas plenums allow cold gas to enter the combustion chamber via the cold gas plenums 22. These outlets within the combustion chamber wall 4 which connect to the cold gas plenums 22 can have shapes which serve to direct the cold gas passing therethrough to have a mean flow direction in a particular direction. More particularly, the openings in the wall of the cold gas plenum 22 proximal to the combustion chamber outlet 8 may direct the cold gas to enter with a component of its mean flow direction parallel with and in the same direction as the primary flow path. This cold gas will have a component which is perpendicular to the primary flow path, but nevertheless the majority of its flow direction may be parallel with the combustion chamber wall 4 as illustrated in FIG. 1. This mean flow direction for the cold gas introduced proximal to the combustion chamber outlet 8 helps to form a protective relatively cool boundary layer of gas around the combustion chamber wall in this region of the combustion chamber in a manner which helps resist erosion of the combustion chamber wall 4.

At a location intermediate the combustion chamber outlet 8 and the primary combustion chamber inlet 6 one or more cold gas plenums 22 have outlets which direct the cold gas to provide a degree of backflow as illustrated in FIG. 1. This backflow is such that the cold gas entering the combustion chamber has a component of its mean flow direction which is parallel to the primary flow path and in an opposite direction to the primary flow path. Such backflowing cold gas helps to mix the cold gas into the combustion vortex (flame) extending from the nozzle 12 in a manner which assists efficient and thorough combustion of the fuel.

As shown in FIG. 1, the cold gas conduits 14, 16, 20 provide a cold gas path between an outer cold gas plenum 24 and the combustion chamber within the combustion chamber wall 4. The cold gas accordingly flows radially inwardly toward the combustion chamber. Thus, as the cold gas is heated as it passes along the cold gas path, the hotter portion of the cold gas will be proximal to the combustion chamber. This helps to maintain heat energy within the combustion chamber thereby improving efficiency.

The recuperator includes hot gas conduits 26 which pass between an inner hot gas plenum 28 and an outer hot gas plenum 30. The hot gas, which may be exhaust gas from a turbine, enters the inner hot gas plenum 28 and flows radially outwardly through the hot gas conduits 26 from which it is collected into the outer hot gas plenum 30 before exiting the recuperator. In this way, the hot gas with the highest temperature is located within the inner hot gas plenum 28 which is closest to the combustion chamber, thereby tending to increase the amount of heat energy maintained within the combustion chamber.

One or more of the hot gas conduits 32 is directed to pass proximal to the fuel conduit 10 and accordingly serves to preheat (e.g. turn into gaseous form) the fuel before it reaches the nozzle 12. In other embodiments, one or more of the cold gas conduits 14, 16, 20 may be routed to be proximal to the fuel conduit 10 to preheat the fuel, or in other embodiments sufficient heat may be conducted through the body of the combined recuperator and combustor to heat the fuel within the fuel conduit 10 to the required degree.

As illustrated in FIG. 1, the hot gas conduits 26 have a diameter "y" which is larger than the diameter of the cold gas conduits "x". The hot gas is typically less dense than the cold gas and arranging for the hot gas conduits to be greater in cross sectional area than the cold gas conduits helps to balance the mass flow of the cold gas relative to the hot gas in a manner which permits a required degree of heat transfer between the hot gas and the cold gas.

The combined recuperator and combustor illustrated in FIG. 1 may be formed of consolidated powder material, such as by energy beam melting of a metal powder as part of an additive manufacturing process. Such techniques are well suited to forming a complex arrangement of conduits, plenums and openings as illustrated in FIG. 1.

A feature of such additively manufactured structures is that it is possible to form such structures in a way in which the material is porous to gaseous flow. Thus, for example, some of the openings in the combustion chamber wall 4 through which cold gas flows may instead (or additionally) be provided by porous openings through a porous portion of the combustion chamber wall 4. As an example, the protective cool boundary layer of cold gas introduced proximal to the combustion chamber outlet 8 may be provided by cold gas flowing through a porous combustion chamber wall bounding the cold gas plenum 22 near the combustion chamber outlet 8 instead of passing through specific openings in the cold gas plenum 22 in that region.

As previously discussed above, the cold gas flowing through the cold gas conduits 14, 16, 20 passes radially inwardly toward the combustion chamber whereas the hot gas passes radially outwardly away from the combustion chamber. This arrangement provides counterflow between the cold gas and the hot gas. The section through the combined recuperator and combustor shown in FIG. 1 illustrates the cold gas conduits 14, 16, 20 in the upper portion and the hot gas conduits in the lower portion. It will be appreciated that in practice, these conduits will be interleaved with each other around the combustion chamber wall 4 as will be illustrated in the following diagrams.

The cold gas conduits 14, 16, 20 and the hot gas conduits 26 may share boundary walls along at least a portion of their lengths in order to reduce the amount of material required to build the combined recuperator and combustor as well as to improve the heat transfer efficiency. The interleaving of the cold gas conduits 14, 16, 20 and the hot gas conduits 26 facilitates such boundary wall sharing.

The illustration of FIG. 1 shows that the cold gas conduits 14, 16, 20 and the hot gas conduits 26 extend outwardly from the combustion chamber wall 4 in a radial direction. In practice, the cold gas conduits 14, 16, 20 and the hot gas conduits 26 may be arranged to extend out from the combustion chamber wall 4 following involute paths that are an involute of an outer cross sectional boundary through the combustion chamber wall 4 in a plane which contains those corresponding involute paths. The use of conduits following such involute curves facilitates the conduits having a substantially constant cross sectional area along their length with a tight packing between the conduits. These features simplify gas flow and increase efficiency as well as reducing the size of the combined recuperator and combustor for a given length of conduit in which heat exchange takes place.

In the examples illustrated herein the combustion chamber is of a substantially cylindrical shape and accordingly has a circular cross section. The involute paths of the conduits accordingly are an involute of a circle. However, it will be appreciated that the combustion chamber can have shapes other than that of a cylinder and in such cases the conduits can follow involute paths that are an involute of an outer cross sectional boundary of the combustion chamber wall 4 which is other than circular, e.g. elliptical. The involute paths in the examples illustrated herein lie in a plane which is perpendicular to the primary flow path through the combustion chamber. However, it is possible that these involute paths could lie in a plane which is not perpendicular to such a primary flow path and yet still meet the requirements of the involute geometry and provide closely packed and substantially constant cross sectional area conduits.

In the example of FIG. 1, the combustor has a circular cross section and the recuperator is a uniform annular shape surrounding the combustor. Illustrated in FIG. 2 are conduits having shared walls and an interleaved arrangement. In the example of FIG. 2 the conduits alternate between cold gas conduits and hot gas conduits. The cold gas conduits supply cold gas moving generally radially inwardly toward the combustion chamber in which the cold gas is then mixed with the combustion gasses. The hot gas flows generally radially outwardly away from the combustion chamber and may comprise, for example, exhaust gas from a turbine from which it is desired to recover heat energy by transferring that heat energy into the cold gas which is then used within the combustion chamber.

FIG. 2 also shows a removable liner 34 disposed between the combustion chamber wall and the combustion chamber. This liner 34 can be replaced, for example if the fuel is diesel and the inside of the combustion chamber suffers from a build up of coke deposits. The combustion chamber wall would still continue to condition and direct the gas flow. The liner 34 may be additively manufactured.

FIG. 3 illustrates a further example embodiment of a combined recuperator and combustor. In this example embodiment, the combustor is again circular in cross section, but the recuperator is not a regular annular cross section, but instead has a scalloped section removed therefrom. This may facilitate the fitting of the combined recuperator and combustor around another part of a heat engine system in order to make a more compact whole.

The examples of the recuperators shown in FIG. 1 and FIG. 2 use counter flow between the cold gas and the hot gas, i.e. the cold gas and the hot gas flow substantially parallel to each other, but in opposite directions through their respective conduits. In contrast, FIG. 3 schematically illustrates an example embodiment in which the cold gas conduits and the hot gas conduits can have a cross flow arrangement in which they cross each other e.g. in a substantially perpendicular direction. Such a cross flow heat exchanger may be preferred in some situations, such as to meet particular manifolding requirements.

FIG. 4 schematically illustrates a heat engine 32 in the form of a turbomachine having a compressor 34 for compressing inlet air to generate compressed cold gas as well as a turbine 36 driven by the hot combustion gas from a combustor 38. The combustor 38 is formed integral with a recuperator 40. The compressed cold gas from the compressor 34 is supplied to the recuperator 40 where it passes through cold gas conduits, as previously described, and is heated by hot gas which passes through hot gas conduits within the recuperator 40. The hot gas within the recuperator 40 is provided by the exhaust gas from the turbine 36. The gas flow path through the turbomachine 32 of FIG. 4 is: inlet air into the compressor 34; compressed cold gas output from the compressor 34 supplied to the cold gas conduits within the recuperator 40; the compressed cold gas when it has been heated within the recuperator 40 passes into the combustion chamber of the combustor 38 where it is mixed with fuel which is burnt to generate the combustion gases; the combustion gasses flow from the combustor 38 to the turbine 36 where they serve to drive rotation of the turbine 36; and the exhaust gasses from the turbine 36 form the hot gas which is supplied to the recuperator 40 and from which residual heat energy is transferred into the compressed cold gas within the recuperator 40.

FIG. 5 schematically illustrates a perspective view of a combined heat exchanger (in this example embodiment in the form of a recuperator) and combustor. FIG. 5 shows a combustor with a substantially cylindrical combustion chamber within the centre of a recuperator which completely surrounds the combustion chamber along its entire length. FIG. 6 shows a cross section through the combined recuperator and combustor of FIG. 5. The conduits through which the hot gas and the cold gas flow are interleaved with each other when passing circumferentially around the cylindrical combustion chamber. The conduits follow involute curves and have a substantially constant cross sectional area along their length facilitated by the use of such involute curves.

FIG. 6, which is the cross sectional view through the combined recuperator and combustor shows the combustion chamber wall 4 having a large number of small openings within it. These openings permit cold gas from the recuperator to enter into the combustion chamber and take part within the combustion process, or protect the combustion chamber wall from excessive heat. The openings may be shaped so as to direct the cold gas entering the combustion chamber through those openings to have particular mean flow directions. Accordingly, the cold gas entering near to the primary combustion chamber inlet can be directed to swirl around the combustion chamber in a direction supporting the vortex flow of the flame extending into the combustion chamber from the primary combustion chamber inlet. The openings partway along the primary flow path within the combustion chamber can be directed to establish a degree of backflow toward the primary combustion chamber inlet in a manner which facilitates the mixing of the cold gas with the flame established at the primary combustion chamber inlet so as to improve combustion efficiency. The openings toward the combustion chamber outlet end of the combustion chamber can direct the cold gas flow toward the combustion chamber outlet in a manner whereby the cold gas forms a protective layer of cold gas close to the combustion chamber wall in a manner which helps to prevent damage/degradation of the combustion chamber wall.

FIG. 7 schematically illustrates an end view of the combined recuperator and combustor looking through the combustion chamber outlet along the centre of the combustion chamber towards the combustion chamber inlet. FIG. 7 illustrates the involute curves of the interleaved cold gas conduits and hot gas conduits. The hot gas conduits are larger in cross section than the cold gas conduits.

Example arrangements of the present technique are set out below in the following clauses:

(1) Apparatus comprising:

a combustion chamber wall enclosing a combustion chamber; and a heat exchanger integral with at least a portion of said combustion chamber wall.

(2) Apparatus according to clause (1), wherein said combustion chamber has a primary combustion chamber inlet and a combustion chamber outlet, and a primary fluid flow path extends between said primary combustion chamber inlet and said combustion chamber outlet.

(3) Apparatus according to clause (2), wherein said heat exchanger at least partially surrounds said combustion chamber in planes normal to at least a portion of said primary fluid flow path.

(4) Apparatus according to clause (3), wherein said heat exchanger fully surrounds said combustion chamber in said planes.

(5) Apparatus according to any one of clauses (3) and (4), wherein said portion comprises all of said primary fluid flow path.

(6) Apparatus according to any one of clauses (4) and (5), wherein said combustion chamber wall has a circular cross section in a plane normal to said primary fluid flow path and said heat exchanger has an annular cross section in said plane normal to said primary fluid flow path.

(7) Apparatus according to any one of clauses (1) to (6), wherein said heat exchanger transfers heat from a hot gas to a cold gas and comprises:

a plurality of hot gas conduits to direct hot gas along respective hot gas paths; and a plurality of cold gas conduits to direct cold gas along respective cold gas paths.

(8) Apparatus according to clause (7), wherein said hot gas paths flow away from said combustion chamber and said cold gas paths flow toward said combustion chamber and are substantially parallel with said hot gas paths.

(9) Apparatus according to clause (7), wherein said hot gas paths are substantially perpendicular to said cold gas paths.

(10) Apparatus according to any one of clauses (7), (8) and (9), wherein said plurality of hot gas conduits and said plurality of cold gas conduits share at least some conduits boundary walls.

(11) Apparatus according to clause (8), wherein said plurality of hot gas conduits and said plurality of cold gas conduits are disposed within said heat exchanger to provide counterflow between said hot gas and said cold gas.

(12) Apparatus according to any one of clauses (7) to (11), wherein one or more of:

at least some of said cold gas conduits directly connect to respective inlet openings in said combustion chamber wall;

at least some of said cold gas conduits directly connect to one or more cold gas plenums abutting said combustion chamber wall and plenum-inlet openings provide flow paths for said cold gas between respective ones of said one or more cold gas plenums and said combustion chamber; and said combustion chamber wall is porous and said cold gas passes from at least some of said cold gas conduits into said combustion chamber through porous openings in said combustion chamber wall.

(13) Apparatus according to clause (2) and any one of clauses (7) to (12), wherein at least some of said cold gas conduits provide said cold gas to said primary combustion chamber inlet.

(14) Apparatus according to any one of clauses (7) to (13), comprising one or more inner hot gas plenums proximal to said combustion chamber wall to supply said hot gas to at least some of said hot gas conduits and one or more outer hot gas plenums distal from said combustion chamber wall for collecting said hot gas from least some of said hot gas conduits.

(15) Apparatus according to any one of clauses (7) to (14), comprising one or more fuel conduits to supply fuel to said combustion chamber and disposed one of:

proximal to one or more hot gas conduits such that heat from said hot gas heats said fuel;

proximal to one or more cold gas conduits such that heat from said cold gas heats said fuel; and to absorb heat from said heat exchanger.

(16) Apparatus according to clause (2) and clause (15), wherein said one or more fuel conduits supply said fuel to said primary combustion chamber inlet.

(17) Apparatus according to any one of clauses (7) to (16), wherein respective ones of said hot gas conduits and said cold gas conduits follow involute paths that are an involute of an outer cross sectional boundary through said combustion chamber wall in a cross sectional plane containing a corresponding involute path.

(18) Apparatus according to clause (17), wherein said outer cross sectional boundary is circular.

(19) Apparatus according to any one of clauses (7) to (18), wherein said hot gas conduits and said cold gas conduits are interleaved around said combustion chamber.

(20) Apparatus according to any one of clauses (7) to (19), wherein said hot gas conduits have cross sectional areas normal to said hot gas paths that are greater than cross sectional areas of said cold gas conduits normal to said cold gas paths.

(21) Apparatus according to any one of clauses (7) to (20), wherein one or more of said cold gas conduits supply said cold gas into said combustion chamber through respective combustion chamber inlet openings, one or more of said combustion chamber inlet openings directing said cold gas to enter said combustion chamber in a mean flow direction non-normal to said combustion chamber wall at a respective one of said one or more combustion chamber inlet openings.

(22) Apparatus according to clause (2) and clause (21), wherein at least one of:

one or more of said combustion chamber inlet openings proximal to said primary combustion chamber inlet direct said cold gas to enter said combustion chamber with a mean flow direction rotating around said primary flow path;

one or more of said combustion chamber inlet openings proximal to said combustion chamber outlet direct said cold gas to enter said combustion chamber with a mean flow direction having a component parallel with and in a same direction as said primary flow path; and one or more of said combustion chamber inlet openings proximal to an intermediate position along said primary flow path direct said cold gas to enter said combustion chamber in a mean flow direction with a component in an opposite direction from said primary flow path.

(23). Apparatus according to any one of the preceding clauses, wherein said apparatus is formed of consolidated powder material.

(24). Apparatus according to any one of the preceding clauses, wherein said heat exchanger is a recuperator.

(25). Apparatus according to clause (24), comprising:

a turbine to extract energy from combustion gas from said combustion chamber and to exhaust said hot gas; and a compressor to compress said cold gas for supply to said combustion chamber, wherein said recuperator is configured to transfer heat from said hot gas leaving said turbine to said cold gas for supply to said combustion chamber.

(26) Apparatus according to any one of the preceding clauses comprising a removable combustion chamber liner disposed between said combustion chamber wall and said combustion chamber.

The invention claimed is:

1. Apparatus comprising:

a combustion chamber wall enclosing a combustion chamber; and a heat exchanger integral with at least a portion of said combustion chamber wall;

wherein the heat exchanger and the combustion chamber wall are formed together as one entity from a single body of material;

wherein said heat exchanger transfers heat from a hot gas to a cold gas and comprises a plurality of hot gas conduits to direct hot gas along respective hot gas paths, and a plurality of cold gas conduits to direct cold gas along respective cold gas paths, wherein a portion of said combustion chamber wall is porous and said cold gas passes from at least some of said cold gas conduits into said combustion chamber through porous openings in said combustion chamber wall; and wherein:

(i) at least some of said cold gas conduits directly connect to respective inlet openings in said combustion chamber wall; and (ii) at least some of said cold gas conduits directly connect to one or more cold gas plenums abutting said combustion chamber wall and plenum-inlet openings provide flow paths for said cold gas between respective ones of said one or more cold gas plenums and said combustion chamber.

2. Apparatus as claimed in claim 1, wherein said combustion chamber has a primary combustion chamber inlet and a combustion chamber outlet, and a primary fluid flow path extends between said primary combustion chamber inlet and said combustion chamber outlet.

3. Apparatus as claimed in claim 2, wherein said heat exchanger at least partially surrounds said combustion chamber in planes normal to at least a portion of said primary fluid flow path.

4. Apparatus as claimed in claim 3, wherein said heat exchanger fully surrounds said combustion chamber in said planes, said combustion chamber wall has a circular cross section in a plane normal to said primary fluid flow path and said heat exchanger has an annular cross section in said plane normal to said primary fluid flow path.

5. Apparatus as claimed in claim 2, wherein at least some of said cold gas conduits provide said cold gas to said primary combustion chamber inlet.

6. Apparatus as claimed in claim 1, wherein said plurality of hot gas conduits and said plurality of cold gas conduits share at least some conduits boundary walls.

7. Apparatus as claimed in claim 1, wherein said plurality of hot gas conduits and said plurality of cold gas conduits are disposed within said heat exchanger to provide counterflow between said hot gas and said cold gas.

8. Apparatus as claimed in claim 1, comprising one or more inner hot gas plenums proximal to said combustion chamber wall to supply said hot gas to at least some of said hot gas conduits and one or more outer hot gas plenums distal from said combustion chamber wall for collecting said hot gas from least some of said hot gas conduits.

9. Apparatus as claimed in claim 1, comprising one or more fuel conduits to supply fuel to said combustion chamber and disposed one of:

proximal to one or more hot gas conduits such that heat from said hot gas heats said fuel;

proximal to one or more cold gas conduits such that heat from said cold gas heats said fuel; and to absorb heat from said heat exchanger.

10. Apparatus as claimed in claim 9, wherein said combustion chamber has a primary combustion chamber inlet and a combustion chamber outlet, and a primary fluid flow path extends between said primary combustion chamber inlet and said combustion chamber outlet, and said one or more fuel conduits supply said fuel to said primary combustion chamber inlet.

11. Apparatus as claimed in claim 1, wherein respective ones of said hot gas conduits and said cold gas conduits follow involute paths that are an involute of an outer cross sectional boundary through said combustion chamber wall in a cross sectional plane containing a corresponding involute path.

12. Apparatus as claimed in claim 11, wherein said outer cross sectional boundary is circular.

13. Apparatus as claimed in claim 1, wherein said hot gas conduits and said cold gas conduits are interleaved around said combustion chamber.

14. Apparatus as claimed in claim 1, wherein said hot gas conduits have cross sectional areas normal to said hot gas paths that are greater than cross sectional areas of said cold gas conduits normal to said cold gas paths.

15. Apparatus as claimed in claim 1, wherein one or more of said cold gas conduits supply said cold gas into said combustion chamber through respective combustion chamber inlet openings, one or more of said combustion chamber inlet openings directing said cold gas to enter said combustion chamber in a mean flow direction non-normal to said combustion chamber wall at a respective one of said one or more combustion chamber inlet openings.

16. Apparatus as claimed in claim 1, wherein said apparatus is formed of consolidated powder material.

17. Apparatus as claimed in claim 1, wherein said heat exchanger is a recuperator.

18. Apparatus as claimed in claim 17, comprising:

a turbine to extract energy from combustion gas from said combustion chamber and to exhaust said hot gas; and a compressor to compress said cold gas for supply to said combustion chamber, wherein said recuperator is configured to transfer heat from said hot gas leaving said turbine to said cold gas for supply to said combustion chamber.

19. Apparatus as claimed in claim 1 comprising a removable combustion chamber liner disposed between said combustion chamber wall and said combustion chamber.

20. A non-transitory storage medium storing a computer-readable data structure representing a design of an apparatus according to claim 1.

21. The apparatus as claimed in claim 1, wherein one or more of comprises wherein at least some of said cold gas conduits directly connect to one or more cold gas plenums abutting said combustion chamber wall and plenum-inlet openings provide flow paths for said cold gas between respective ones of said one or more cold gas plenums and said combustion chamber.

* * * * *